United States Patent [19]

Imhoff

[11] 4,198,082

[45] Apr. 15, 1980

[54] SURFACE BOLT

[75] Inventor: William B. Imhoff, Springdale, Conn.

[73] Assignee: Leigh Products, Inc., Coopersville, Mich.

[21] Appl. No.: 919,085

[22] Filed: Jun. 26, 1978

[51] Int. Cl.[2] ..... E05C 1/04

[52] U.S. Cl. ..... 292/67; 292/162

[58] Field of Search ..... 292/67, 48, 63, 64, 292/65, 66, 68, 69, 147, 148, 162

[56] References Cited

U.S. PATENT DOCUMENTS

| | | | |
|---|---|---|---|
| 652,606 | 6/1900 | Field | 292/69 |
| 2,620,213 | 12/1952 | Keeler | 292/147 |
| 4,021,063 | 5/1977 | Porter | 292/67 |
| 4,060,266 | 11/1977 | Wilkinson | 292/148 |

FOREIGN PATENT DOCUMENTS

| | | | |
|---|---|---|---|
| 333382 | 2/1920 | Fed. Rep. of Germany | 292/67 |
| 614146 | 12/1960 | Italy | 292/147 |
| 237939 | 9/1944 | Switzerland | 292/67 |

*Primary Examiner*—J. Franklin Foss

*Attorney, Agent, or Firm*—DeLio and Montgomery

[57] ABSTRACT

A surface bolt which is latched against retraction when in a latching position and requires movement transverse to its length in order to unlatch the bolt for retraction.

5 Claims, 5 Drawing Figures

SURFACE BOLT

This invention relates to surface bolts and more particularly to surface bolts having a construction which inhibits unauthorized unlocking from the outside.

Surface bolts are quite well known and comprise a bolt member which is slidable in guides into a keeper. One of the bolt and the keeper is mounted to a fixed surface while the other is mounted to a movable surface, such as a pivotal door.

It is not uncommon that such a bolt can be manipulated to remove it from extension into the keeper from outside and thus permit unauthorized entry.

The present invention provides a new, improved and simplified bolt assembly construction which inhibits unlocking of the bolt from the exterior side by requiring an additional movement of the extended bolt in a direction transverse to its normal direction of operation to thus inhibit unauthorized entry.

Briefly stated, the invention, in one form thereof, comprises an elongated bolt member which is longitudinally slidable into and out of engagement with a keeper. The bolt member, which is of generally channel-shaped configuration, is slidable on the underside of a guide member which carries biasing means urging the bolt away therefrom, and normally maintaining contact between the bolt member and the undersurface of the guide member. Detent means are provided between the guide member and the bolt member which are engageable when the bolt is in an extended position and received in the keeper, and such detent means prevents withdrawal of the bolt from the keeper unless the bolt is moved against the bias of the spring to disengage the detent and permit retraction of the bolt. Means are further provided such that the bolt may only be moved against the biasing means to release the detent adjacent the non-locking end thereof, removed from the end which may extend into the keeper. The bolt member is of generally channel shape with rails extending inwardly from the free arms thereof and engaging the guide member. The detent means are formed by interruptions in the undersurface of the guide member and projections from the rail members of the bolt.

An object of this invention is to provide a new, improved and simplified surface bolt construction which includes detent means for locking the bolt in an extended locking position and which requires movement of the bolt transverse to its normal sliding movement to release such detent means.

A further object of this invention is to provide a bolt construction of the type described wherein the locking detent means is formed from the guide member and on the bolt member without the requirement for additional parts.

The features of the invention which are believed to be novel are particularly pointed out and distinctly claimed in the concluding portion of this specification. The invention, however, both as to its organization and operation, together with further objects and advantages thereof may best be appreciated by reference to the following detailed description taken in conjunction with the drawings, wherein:

Figures 1, 2, 3, 4, 5:
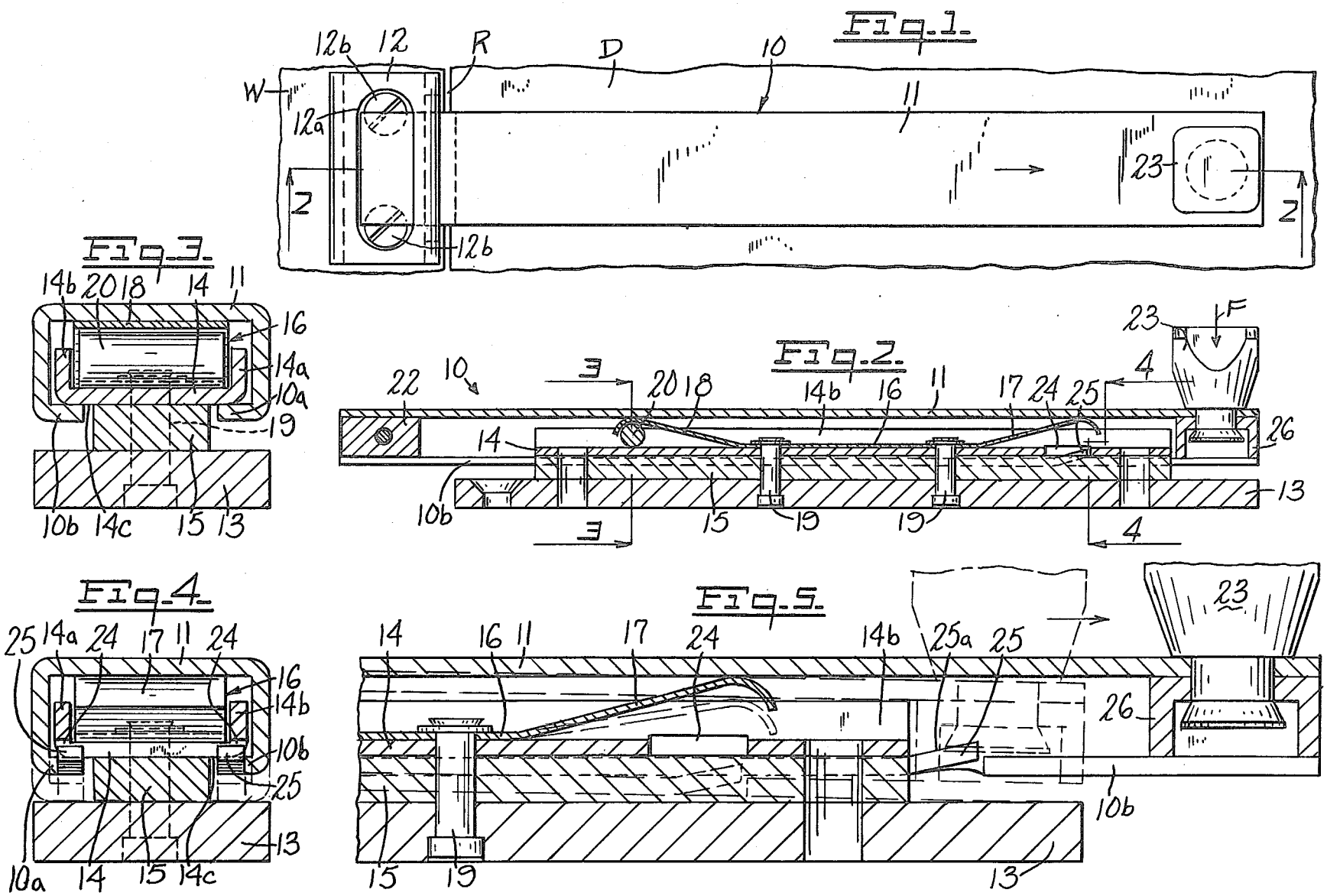
FIG. 1 is a view of a bolt assembly, including keeper, embodying the invention mounted in an operative position.
FIG. 2 is a sectional view seen in the plane of lines 2—2 of FIG. 1 with the keeper not shown.
FIG. 3 is a sectional view seen in the plane of lines 3—3 of FIG. 2.
FIG. 4 is a sectional view seen in the plane of lines 4—4 of FIG. 2.
FIG. 5 is an enlarged view of a portion of FIG. 2 in section and further illustrating the operation of the bolt.

A bolt assembly 10 embodying the invention comprises a bolt 11 movable into and out of engagement with a keeper 12. As shown, keeper 12 is mounted to a relatively fixed surface, such as a wall W, while the bolt 11 is mounted to a movable surface such as on a door D. The bolt and keeper may also be mounted cooperatively on a pair of swinging doors. Keeper 12 is of closed channel or box configuration in cross-section with an opening **12*a* therein to permit access to mounting screws 12*b*. This construction conceals the mounting screws 12*b*** when the bolt is in an operative position.

As shown in FIGS. 2 and 3, the bolt comprises a mounting plate 13 having affixed thereto a guide member 14 positioned for mounting on plate 13 by means of a spacer 15. Carried by guide means 14 is a spring member 16 having spaced-apart leafs 17 and 18 acting on the underside of bolt member 11 and urging bolt member 11 away from guide 14. The mounting plate 13, spacer 15, guide member 14, and spring 16 may be all secured together as by means of fasteners 19. A pin 20 is captured under the end of leaf 18 for purposes hereinafter described.

Guide member 14, as shown, is in the shape of a channel having upstanding flanges **14*a* and 14*b*. The bolt member 11 is also of generally channel shape but has continuous arms or rails 10*a* and 10*b* which engage undersurface 14*c* of guide member 14 and have sliding contact therewith. Normally, the spring leafs 17 and 18 hold rails 10*a* and 10*b* in contact with surface 14*c*. A closure member 22 is removably fixed in the keeper end of bolt member 11 as by means of a set screw. A knob or handle 23 is affixed to the actuating or free end of bolt member 11**.

The undersurface **14*c* of member 14 is interrupted as indicated at 24 at a location adjacent the free or actuating end of bolt member 11 to provide a detent. Cooperating projections 25 which may be termed "ears" are struck from rails 10*a* and 10*b* and together with interruptions 24 provide a detent means. Thus, when bolt member 11 is moved into an operative locking position, as shown in FIG. 2, the projections 25 will extend into detent 24. This will latch bolt member 11 from retraction from keeper 12** by a strictly longitudinal pull.

In order to unlatch the bolt member 11 so that it may be retracted, a force F is applied to handle 23 which will move bolt member 11 downwardly against the bias of leaf 17 and permit projections 25 to leave detent 24, as shown in FIG. 5. Thereafter, bolt member 11 may be retracted from the broken line position shown in FIG. 5 to the full line position.

When it is again desired to extend the bolt into engagement with the keeper 12, the bolt is moved to the left, as viewed in FIG. 5. Surface **25*a* of projection 25 will easily ride under the leading edge of guide member 14 until filler member 26 at the handle end of bolt member 11 abuts guide 14. This is chosen so that projection 25 will make engagement in detent 24. Pin 20 prohibits any transverse movement of bolt member 11 towards guide member 14 adjacent the keeper end of the bolt. Thus, it would be extremely difficult if not impossible for anyone to insert a tool through the opening R between wall W and door D and depress bolt member 11** adjacent the edge of the door D.

When in an extended locking position, the bolt member 11 may only be removed from a latched position with respect to guide 14 by exerting a force at or very closely adjacent the free end thereof.

It will be understood that interruptions 24 could be located in the bolt and the projections on the guide member to obtain the same operation and result. In this arrangement, the projections on the guide would be oppositely directed with respect to those shown on the bolt.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments which do not depart from the spirit and scope of the invention.

What is claimed is:

1. A surface bolt comprising an elongated guide member, an elongated bolt, said bolt being mounted to said guide member for longitudinal movement thereon, biasing means carried by said guide member and acting on said bolt member to urge said bolt member away from said guide member whereby said biasing means normally maintains said bolt member in a spaced relation from said guide member, means for mounting said guide member to one of a fixed surface and a relatively movable surface, a keeper adapted to receive said bolt member when in an extended position, said keeper adapted to be mounted to the other of the fixed surface and the movable surface, said means for mounting said guide member comprising passages extending therethrough for receipt of fastening devices, said bolt enclosing said guide member and covering said means for mounting, detent means defined between said guide member and said bolt to latch said bolt against retraction when said bolt is in an extended position to said keeper whereby said bolt cannot be retracted from said keeper unless said bolt is moved against said biasing means toward said guide member to unlatch said detents.

2. The surface bolt of claim 1 wherein said bolt has a free end, means preventing any substantial movement of said bolt against said biasing means adjacent said keeper, whereby said bolt must be moved against said biasing means adjacent the free end thereof to unlatch said detent means.

3. A surface bolt comprising an elongated guide member, an elongated bolt, said bolt being mounted to said guide member for longitudinal movement thereon, said bolt being a channel-like member having inwardly directed arms at the free ends thereof, said arms engaging the underside of said guide member, biasing means carried by said guide member and acting on said bolt member to urge said bolt member away from said guide member whereby said biasing means normally maintains said bolt member in a spaced relation from said guide member, means for mounting said guide member to one of a fixed surface and a movable surface, a keeper adapted to receive said bolt member when in an extended position, said keeper adapted to be mounted to the other of the fixed surface and the movable surface, detent means defined between said guide member and said bolt to latch said bolt against retraction when said bolt is in an extended position in said keeper whereby said bolt cannot be retracted from said keeper unless said bolt is moved against said biasing means toward said guide member to unlatch said detents, said detent means comprising an interruption in one of said inwardly directed arms and said guide member, and a projection on the other of said arm and guide member.

4. The bolt of claim 3 wherein said biasing means is a leaf spring having two free ends urging said bolt from said guide member at spaced apart positions longitudinally of said bolt, and means disposed beneath the free end of the spring adjacent the keeper end of the bolt preventing any substantial movement of the bolt toward the guide member.

5. A surface bolt comprising an elongated guide member having an underside, an elongated bolt member of generally U-shaped cross-section and having inwardly directed arms from the free ends of the U-shape, said arms contacting the underside of said guide member, biasing means carried by said guide member and acting on said bolt member to urge said bolt member away from said guide member whereby said biasing means normally maintains said bolt member in spaced relation from said guide member and said arms in contact with the underside of said guide member, means for mounting said guide member to one of a fixed surface and a movable surface, a keeper adapted to receive said bolt member when in an extended position, said keeper adapted to be mounted to the other of the fixed surface and the movable surface, said guide member having discontinuities in said undersurface defining a detent, said bolt member having projections on said arms extending upwardly therefrom and arranged to enter said detent when said bolt is extended into said keeper whereby said bolt cannot be retracted from engagement with said keeper unless said bolt is moved against said biasing means toward said guide member to free said projections from said detents.

* * * * *